US005653569A

United States Patent [19]

Sears

[11] Patent Number: 5,653,569

[45] Date of Patent: Aug. 5, 1997

[54] TURN-TABLE ATTACHMENT FOR FORK LIFT VEHICLE

[76] Inventor: David E. Sears, 86 Douglas St., Homosassa, Fla. 34446

[21] Appl. No.: 584,895

[22] Filed: Jan. 10, 1996

[51] Int. Cl.[6] ..... B66F 9/06

[52] U.S. Cl. ..... 414/607; 414/665

[58] Field of Search ..... 414/607, 590, 414/662–666, 688–670, 672, 347; 104/37, 45, 46

[56] References Cited

U.S. PATENT DOCUMENTS

| | | | |
|---|---|---|---|
| 2,410,373 | 10/1946 | Westervelt, Jr. | 414/607 |
| 2,780,377 | 2/1957 | Glenn, Jr. et al. | 414/607 X |
| 3,275,166 | 9/1966 | Shannon | 414/672 X |
| 3,498,485 | 3/1970 | Godbersen | 414/607 X |
| 3,556,328 | 1/1971 | Miles et al. | 414/607 |
| 3,643,825 | 2/1972 | Zane, Jr. | 414/607 |
| 3,701,446 | 10/1972 | Smith, Jr. | 414/670 |
| 3,757,977 | 9/1973 | Brudi et al. | 414/607 |
| 3,850,322 | 11/1974 | Miles et al. | 414/607 |
| 3,998,345 | 12/1976 | Fiehler et al. | 414/666 X |
| 4,069,932 | 1/1978 | Stedman | 414/664 |
| 4,457,656 | 7/1984 | Kosina et al. | 104/37 X |
| 4,474,495 | 10/1984 | Ledwell, Jr. | 414/663 X |
| 4,755,099 | 7/1988 | Belveal | 414/665 X |
| 5,383,758 | 1/1995 | Patrick | 414/607 X |

FOREIGN PATENT DOCUMENTS

| | | | |
|---|---|---|---|
| 976385 | 8/1963 | Germany | 414/665 |
| 291397 | 12/1990 | Japan | 414/665 |
| 1388616 | 3/1975 | United Kingdom | 414/666 |

*Primary Examiner*—David A. Bucci
*Attorney, Agent, or Firm*—McCaleb, Lucas & Brugman

[57] ABSTRACT

A turn-table attachment mountable on the tines of a vehicle mounted, vertically moveable, lift fork comprising a base frame with tubular tine receptive sockets, a turn-table rotatable about a fixed vertical axis projecting upwardly from the base frame, an auxiliary lift fork mounted in fixed position on the turn-table and having parallel spaced fork tines projecting radially outwardly of the turn-table periphery, power operated actuators carried by the base frame and selectively coupled to the turn-table for rotating the latter through an arc of at least 180° whereby to position the auxiliary forks on opposite sides of the vehicle as selected.

2 Claims, 5 Drawing Sheets

TURN-TABLE ATTACHMENT FOR FORK LIFT VEHICLE

This invention relates to an auxiliary attachment for the tines of a vertically moveable lift fork associated with a conventional front loading fork lift truck whereby loading, carrying and unloading of loads on opposite lateral sides of the lift truck is made possible.

Industrial lift trucks are commonly used for engaging loads and depositing the same in suitable storage areas; such lift trucks normally incorporating parallel, generally horizontal fork tines mounted for movement along a vertical mast and extending forwardly and symmetrically of the longitudinal or movement axis of the vehicle. Such vehicles find particular adaptation for loading and unloading loads at various elevations in accordance with the vertical extent of their masts. Inasmuch as the lift forks are generally located at the leading or front end of the conventional lift truck vehicle, engaging and moving elongated loads such as pipes, metal beams, lumber and the like through or along aisles or transit areas having a width less than the length of the load cannot be accomplished without a special attachment for aligning and supporting the load in front of the vehicle parallel to the movement axis of the vehicle. With such attachment, a question of balance between load and vehicle becomes important since a heavy load supported well in advance of the vehicle's center of gravity may easily unbalance the vehicle, creating a dangerous condition for the operator. Even in instances where the aisle or passageway is wider than an elongated load disposed transversely of the vehicle's movement axis, maneuvering of the vehicle for the purpose of unloading or loading the fork lift becomes extremely difficult and cumbersome.

The present invention is directed to alleviation of the aforenoted difficulties and problems of front loading industrial fork lift vehicles and the like.

It is an important object of this invention to provide an auxiliary attachment for the forks of a conventional front loading fork lift truck that is economical to manufacture, convenient to use and capable of being positioned to load and unload articles at opposite sides of the vehicle.

Another object of this invention is to provide a front loading lift truck equipped with parallel fork tines, symmetrical of the movement axis of the vehicle and carried for movement along a vertical mast, with a suitable attachment for converting the front loading and unloading lift truck into a side loading and unloading vehicle.

A still further important object of this invention is to provide an auxiliary device for converting a normal front loading lift truck into a side loading lift truck capable of loading, carrying and unloading elongated loads on either side of the lift truck as selected.

BRIEF SUMMARY OF THE INVENTION

In brief, this invention is directed to a portable attachment adapted to be carried by the fork tines of a front loading lift fork truck in which the lift fork moves along a vertical mast; the attachment hereof comprising a base frame having means receptive of the tines of the truck's lift fork, a substantially horizontal turn table mounted for rotation about a vertical axis located centrally of the base frame, an auxiliary lift fork fixed to the platform and having spaced tines extending radially outwardly of the platform's periphery, and power actuated means carried by the base frame for selectively rotating the turn table between limits whereby to align the auxiliary lift fork transversely of the lift truck's travel axis so that loads may be engaged, transported and discharged on either side of the lift truck.

Having described this invention, the above and further objects, features and advantages thereof will appear from time to time from the following detailed description of a preferred embodiment thereof, illustrated in the drawings and presenting the best mode presently contemplated for practicing this invention.

IN THE DRAWINGS

DESCRIPTION OF THE PREFERRED EMBODIMENT

Figures 1, 2:
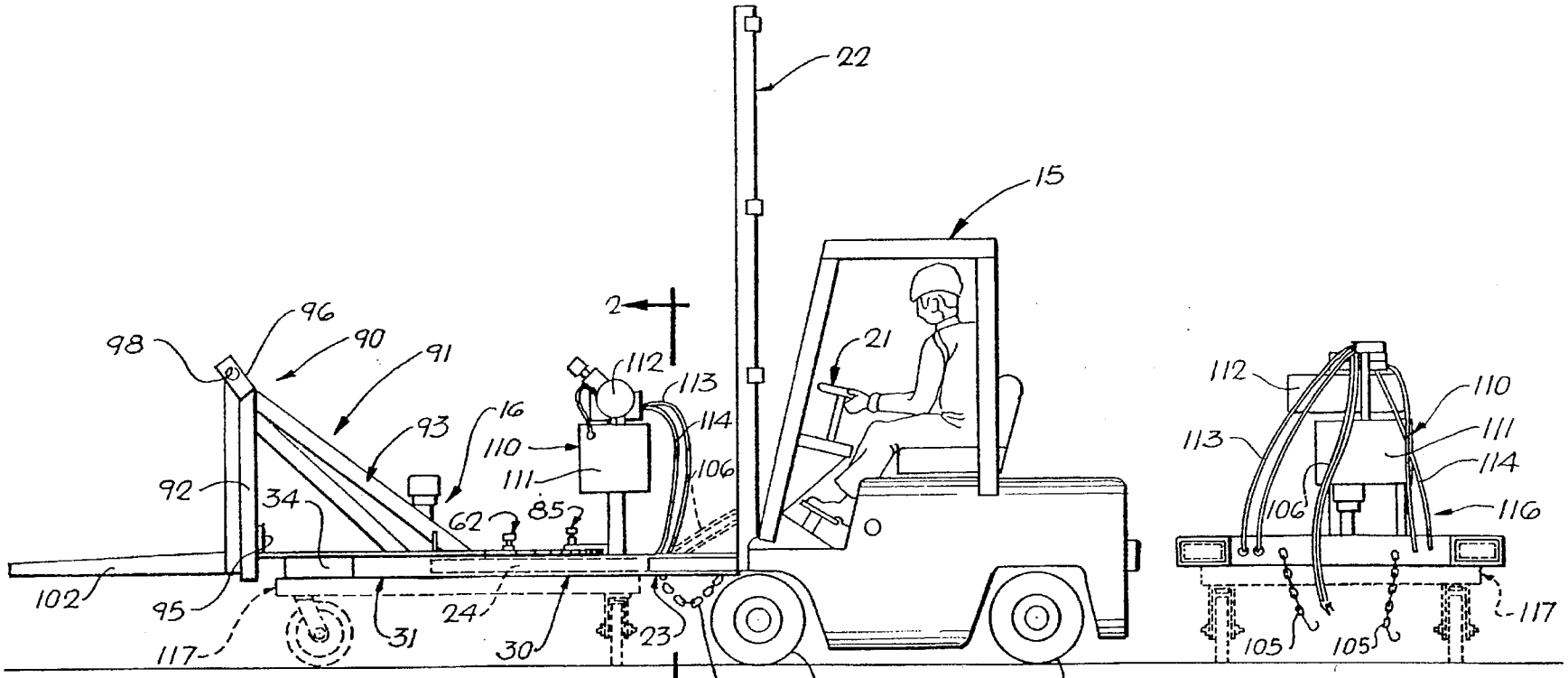
FIG. 1 is a side elevational view of a typical vertical fork lift truck assembled with an auxiliary turn table attachment according to this invention.
FIG. 2 is rear end elevational view of the turn table attachment shown in FIG. 1 taken substantially from vantage line 2—2 of that figure and looking in the direction of the arrows thereon.

As shown in FIG. 1, 15 generally indicates a fork lift truck of the counter balance type equipped with an auxiliary turn table attachment, indicated generally at 16, in accordance with this invention. It will be noted that attachment 16 is carried on a wheeled dolly 17 indicated by dotted lines in FIGS. 1 and 2 for convenience in loading the same onto and off of the fork lift truck.

Figure 5:
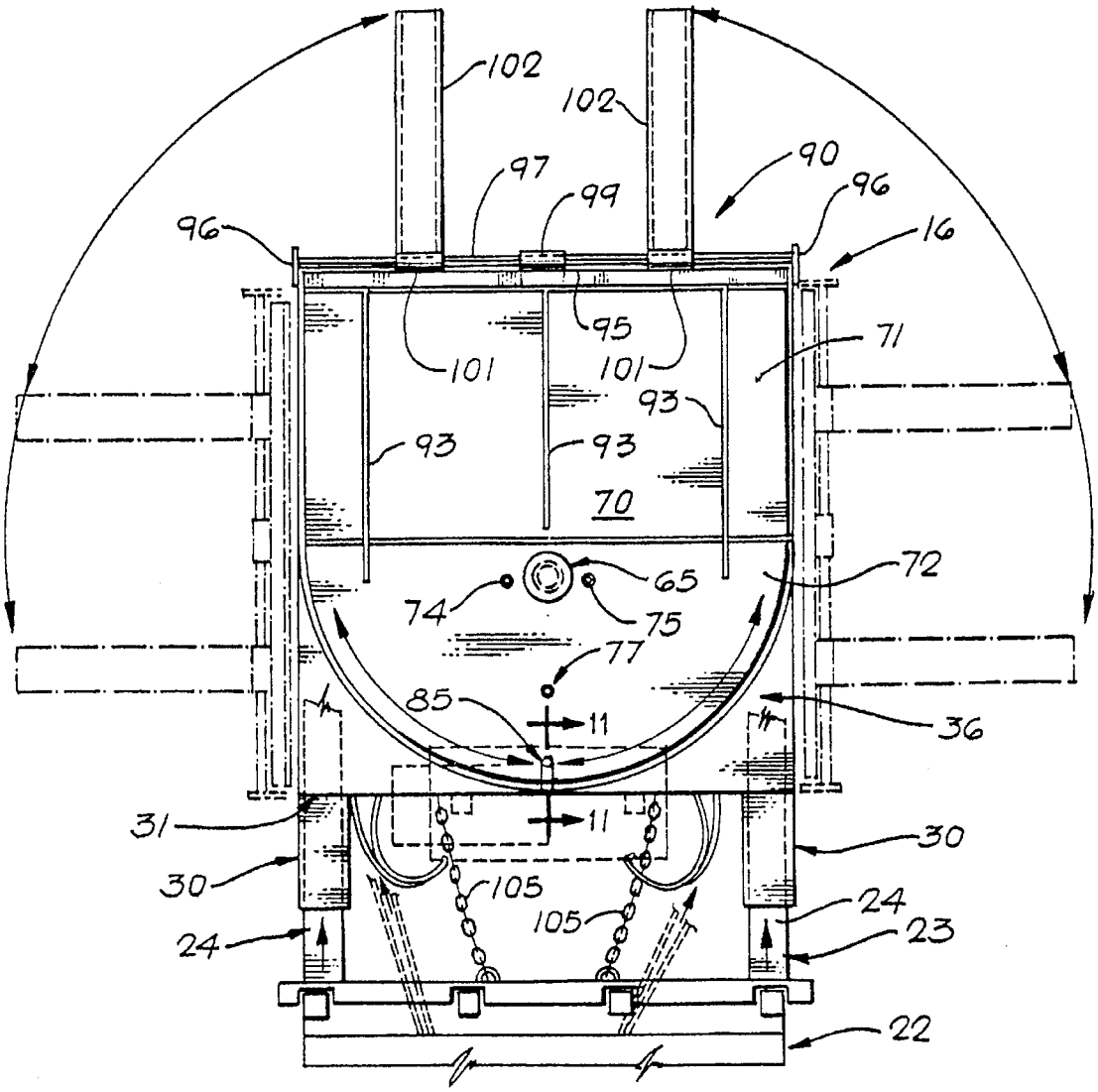
FIG. 5 is a top plan view of the turn table attachment hereof assembled with the tines of the fork lift truck shown in FIG. 1.

Basically truck 15 comprises ground engaging wheels 20, 20, a steering mechanism 21, a vertical mast structure 22 disposed at the front end of the vehicle with forwardly extending fork lift assembly 23 moveable vertically along the mast in conventional manner; typically in response to operation of a hydraulic system and controls (not shown) associated with truck 15. As best shown in FIG. 5, lift fork assembly 23 comprises a pair of linear, laterally spaced rigid fork tines 24, 24 adapted to engage pallet loads and lift them for transportation from place to place in accordance with the movements of the truck or vehicle 15.

It will be recognized from FIG. 1 that assembly 16 is adapted to be coupled to the lift fork assembly 23 of the lift truck by insertion of the fork tines 24 thereof into appropriately spaced, elongated box frame members 30, 30 presenting laterally spaced sockets for receiving the tines 24, 24 as the lift truck 15 advances toward the assembly 16.

It will be understood that while assembly 16 is shown herein as undersupported by a wheeled dolly for purposes of being loaded onto and off of the forks of the lift truck, such dolly is not essential to the practice of this invention, but is illustrated as a matter of convenience. Loading of assembly 16 onto the forks of the lift truck also may take place when assembly 16 is positioned on the ground with equal facility.

With reference to FIGS. 1–11 of the drawings, the features and structure of the turn table attachment 16 according to this invention will now be set forth.

Figure 6:
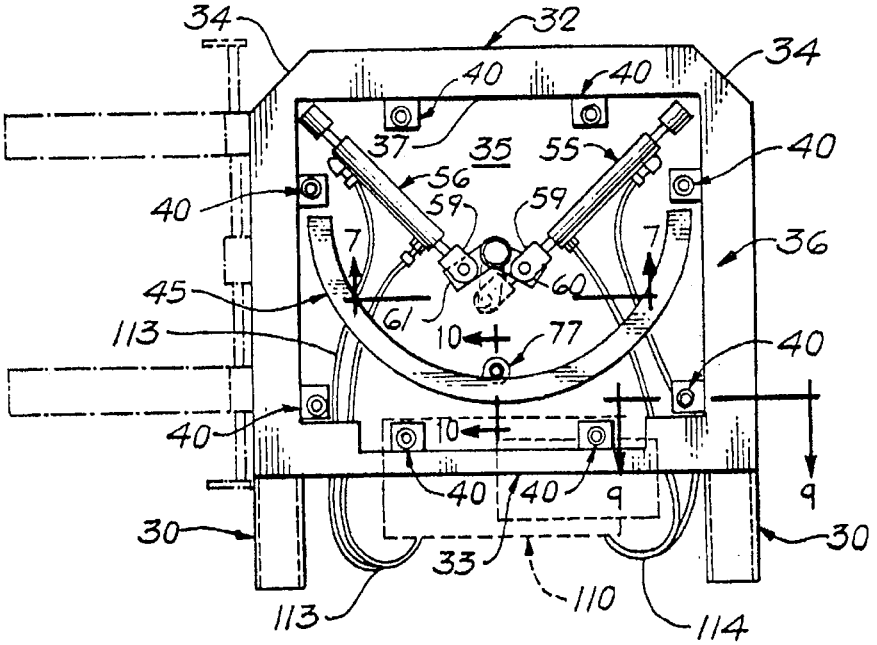
FIG. 6 is a top plan view of the turn table attachment hereof with the turn table and auxiliary lift fork removed.

As best shown in FIGS. 1 and 6 of the drawings, assembly 16 comprises a substantially square, fabricated metal base frame 31 wherein the elongated box frames members 30, 30 thereof comprise lateral side frame members open at one end for the inserted reception of the tines 24, 24 of the lift fork assembly 23. The box frame members 30, 30 are cross connected at their ends by transversely related front and back end plates 32, 33 with the leading or forward end corners of the box frame being angulated as shown at 34 in FIG. 6. A planar bottom plate 35 is rigidly joined to the underside of the various frame members 30, 32–34 and a parallel top plate 36 is fixed to the upper side of the frame members 30, 32–34; it being understood that the entire base frame assembly is fabricated of heavy sheet metal suitably welded together. It will be appreciated that the top plate 36 has an enlarged central opening 37 cut away in a generally square configuration with the four sides of the cut away area paralleling the respective frame members 30, 32–34 (see FIG. 6).

Figure 9:
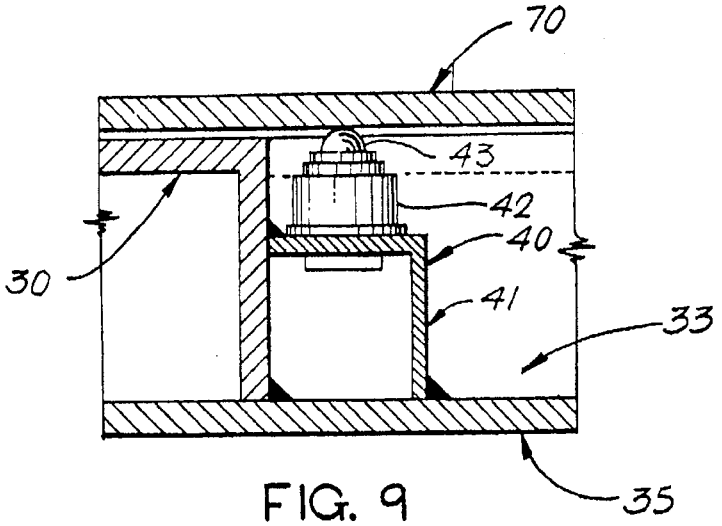
FIG. 9 is an enlarged, partial cross sectional view taken substantially along vantage line 9—9 of FIG. 6 and looking in the direction of the arrows thereon.

As shown in FIGS. 6 and 9 of the drawings, extending upwardly from the base plate 35 and within the peripheral confines of the opening 37 in the top plate 36, are a plurality of bearing assemblies 40, 40 located adjacent the four major corners of substantially square opening 37. In greater particular each assembly 40, as shown in FIG. 9, comprises a support stand 41 welded to the base plate 35 and in the cross sectional configuration of FIG. 9, to one of the tubular box frame members 30 whereas others of the assemblies 40 are similarly secured to the same or other frame members of the base frame 31. It will be noted that each of the assemblies 40 comprises a generally cylindrical bearing cage 42 having a single ball bearing 43 rotatably secured in a socket (unnumbered) at the upper end of the cage 42 for purposes which will appear hereinafter.

Figure 10:
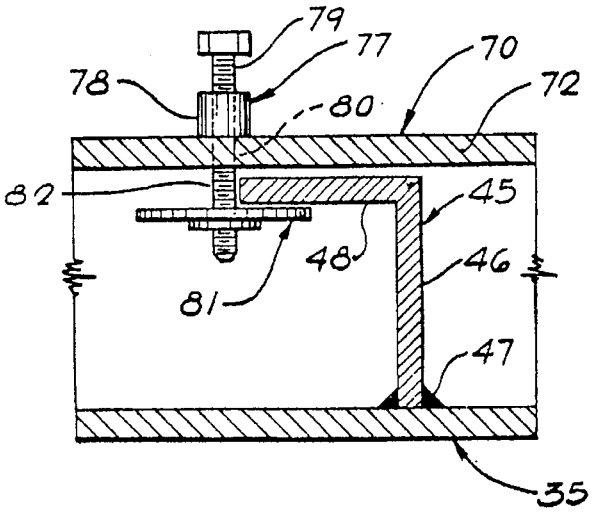
FIG. 10 is another enlarged, partial cross sectional view taken substantially along vantage line 10—10 of FIG. 6 and looking in the direction of the arrows thereon.

Mounted symmetrically of the transverse central axis of base plate 35 is a semi-circular guide track 45 extending upwardly from the base plate and comprising a right angular metal rail having a operationally vertically disposed leg 46 suitably welded to the base plate 35 as indicated at 47 in FIGS. 6 and 10. A horizontal planar rail arm 48 extends to one side of leg 46 and is configured in the arcuate or semi-circular shape shown in FIG. 6 of the drawings. The purpose of this guide rail will appear hereinafter.

Figure 7:
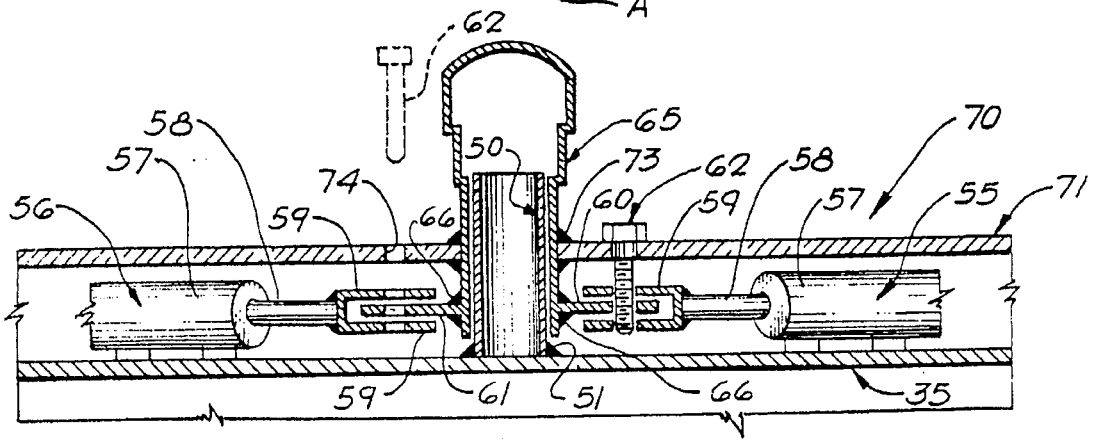
FIG. 7 is a partial, enlarged cross sectional view taken substantially along vantage line 7—7 of FIG. 6 to illustrate the arrangement of parts for rotatably actuating the turn table and auxiliary lift fork.

In addition to the ball bearing assemblies 40 and the guide rail 45, base plate 35 also supports a centrally located tubular trunnion post 50 extending upwardly from substantially the center of the base plate 35; post 50 being suitably welded to base plate 35 at 51 as indicated in FIG. 7.

Located on either side of the trunnion post 50 and extending substantially along the diagonals of the opening 37 at approximately 45° to the central fore and aft axis of the the base frame 31, are a pair of hydraulic actuators 55 and 56 each comprising a cylinder 57 having an internal piston (not shown) and a piston rod 58 which extends outwardly of one end of the cylinder 57 in a conventional manner. The piston rod 58 of each of the actuators carries a clevis 59 at its outer end which is coupled to one of two crank arms 60 and 61.

As will appear presently, a connector pin 62 interjoins each clevis 59 to an associated crank arm 60 and 61. The two crank arms 60 and 61 are coaxially aligned on opposite sides of a tubular capped hub member 65 adapted to fit coaxially over the trunnion post 50 for rotation thereabout; the two crank arms 60, 61 being appropriately welded in fixed positions to the hub member as indicated by welds 66 (see FIG. 7).

It will be recognized from FIG. 5 in particular, that over covering the base frame 31 and overlapping the top plate 36 thereof is a planar turn table 70 having a generally rectangular portion 71 at one end and a semi-circular portion 72 extending from portion 71 toward the end of the base frame which is operationally located adjacent the fork lift truck mast 22. The turn table 70 is affixed to tubular hub 65 substantially centrally of the turn table and more particularly substantially at the center point of the semi-circular portion 72 thereof; the turn table 70 being fixed to the hub by means of welds 73 (see FIG. 7). As previously noted the turn table and hub 65 are rotatable about the trunnion 50 in limited fashion depending on the operation of the hydraulic actuators 55 and 56 as will be described in greater detail presently. Further it will be appreciated that the underside of the turn table engages the several single ball bearings 43 of assemblies 40 whereby to support the turn table thereon during its rotational movements about the trunnion.

It will be noted that on either side of the hub member 65 and spaced radially outwardly of such hub, are a pair of openings 75 and 74 as shown best in FIGS. 5 and 7 of the drawings. These openings extend through the turn table 71 and are adapted to coaxially receive the connector pin 62 for intercoupling the clevis and crank arms associated with the actuators 55 and 56 and the hub members 65 as selected.

In operation it is preferred in accordance with the herein illustrated embodiment, that the pin 62 be engaged with only one crank arm and one clevis at a time so as to rotate the turn table 70 either clockwise or counterclockwise as viewed in FIG. 5 of the drawings, whereby accordingly to place auxiliary forks (to be described presently) on either the right or left side of the main frame 31.

As best illustrated in FIGS. 5, 6 and 10 of the drawings, the turn table 70 is fitted with a guide assembly 77 located immediately to the rear of the hub 65 and on the longitudinal center line of the turn table (see FIG. 5). Assembly 77, as best illustrated in FIG. 10 of the drawings, comprises a guide collar 78 fixed to the upper surface of the turn table portion 72 for receiving a threaded bolt 79 which is adapted to extend coaxially through the threaded collar 78 and a threaded opening 80 extending through the turn table portion 72. Adjacent the lower end of the threaded body of the bolt 79, is a large circular bearing collar 81 having threaded connection with the body 87 of the bolt 79; the diameter of the collar 81 being such as to extend beneath the horizontally rail arm 48 of the guide track 45 (see FIG. 10). It will be appreciated that bolt 79 and collar 81 may be vertically adjusted relative to the underface of the horizontal plate or rail arm 48 to provide a desired clearance with the rail.

Figure 11:
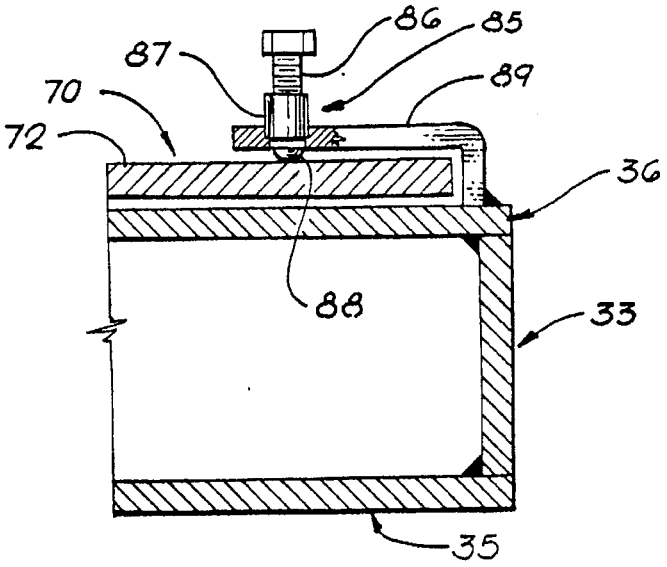
FIG. 11 is an enlarged, partial cross sectional view taken substantially along vantage line 11—11 of FIG. 5 and looking in the directions thereof.

In addition to the guide assembly 77 for underengaging the semi-circular track 45, as illustrated in FIGS. 5 and 11 of the drawings, the rearward edge of the turn table's semicircular portion 72 is embraced by an over hanging rotatable ball bearing assembly 85 comprising a threaded bolt 86 threadingly moveable through a collar portion 87. The lower end of bolt 86 carries a socket held single ball being 88 engageable with the upper surface of the turn table portion 72. The collar 87 is fixed secured over an opening in a L-shaped mounting bracket 89 securely welded to the top frame member 36 immediately adjacent the rearward edge of the turn table portion 72 as illustrated in FIGS. 5 and 11.

From the foregoing it will be readily recognized that the turn table 70 is freely rotatable with hub 65 Coaxially about the trunnion post 50 while being undersupported on the ball bearing assemblies 40. In accordance with operation of the actuators 55 and 56 the turn table is rotated clockwise or counterclockwise, as selected, along an arc of approximately 180°.

Inasmuch as the turn table, as previously noted, is intended to support an auxiliary set of lift forks, whereby to position the tines thereof on opposite sides of a front loading conventional lift truck, it will be recognized from FIGS. 1 and 3–5 that the rectangular portion 71 of the turn table is accordingly fitted with an auxiliary lift fork assembly indicated generally at 90 operable to selectively position loads on either the right or left hand side of the movement axis of the lift truck in accordance with that objective of this invention.

As shown best in FIGS. 1–5 of the drawings, fork assembly 90 comprises a supporting frame work, indicated generally at 91, including two vertical upright members 92 and angle support members 93 connected between a horizontal cross bar 94 (see FIG. 4) and the turn table. The vertical support members 92 extend between the horizontal cross bar and a upwardly turned flange 95 extending along the forward or leading edge of the rectangular portion 71 of the turn table (see FIGS. 1 and 3). At the upper end of the supporting frame work 91 and more specifically at the outer upper ends of the vertical and angulated braces 92 and 93, respectively, are hinge ears 96 best seen in FIGS. 3 and 4. The hinge ears 96 support an elongated pintle or pin 97 therebetween; the same passing through the outer upper end of the intermediate angulated support frame member 93 formed to provide a cylindrical sleeve or hinge portion 99 through which the shaft or pintle 97 passes.

A fork assembly per se is attached to the pintle shaft 98 and comprises a pair of vertical legs 100 which are spaced in parallel relation and disposed in symmetrically spaced position on opposite sides of the longitudinal axis of the turn table; the upper ends of legs 100 being formed with cylindrical collars 101 corresponding to the collar portion 99 of the center support member 93 whereby the two arms 100 are rotatable about the pintle shaft. The legs 100 have a pair of forwardly extending tines 102, 102 at their lower ends extending generally at right angles to the body of the legs 100 to comprise the tines of the auxiliary lift fork. The two legs and tines 100 and 102, respectively, are held in suitably laterally spaced parallel condition by an intervening support beam 105 as shown particularly in FIG. 4 of the drawings.

With the pivotal or hinged arrangement of the auxiliary lift fork as provided by the pivotal attachment thereof to the pintle shaft 97 as described above, the auxiliary lift fork may be swung about the pintle shaft and over the top of the support or brace assembly 91 for storage purposes.

In order to assure safety to the operator of lift trucks equipped with an auxiliary turn table attachment of this invention, a pair of safety chains 105 are provided extending between the forward end of the lift truck 15 immediately below the vertical mast 22 thereof and the rear frame member 33 of the base frame 31, as best shown in FIGS. 1 and 5 of the drawings.

Figure 3:
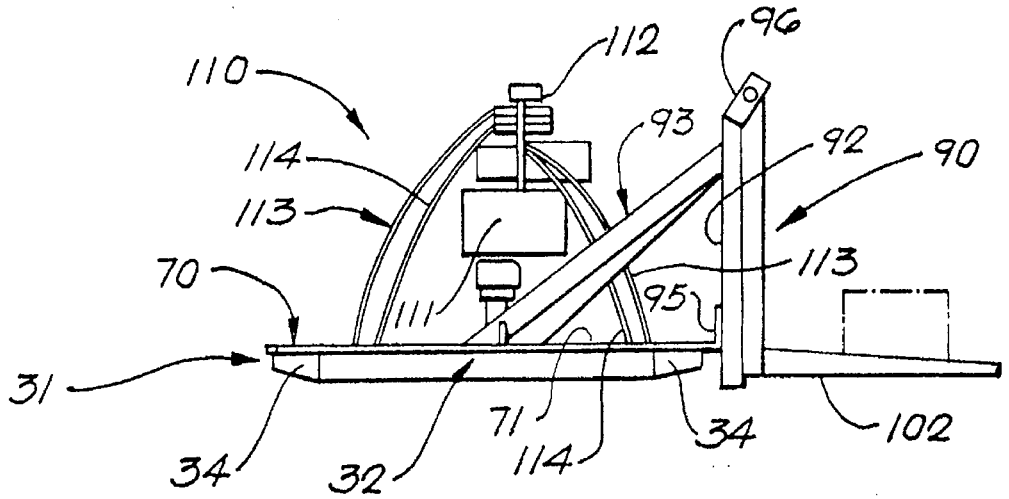
FIG. 3 is a front end elevational view of the auxiliary attachment hereof having its auxiliary fork oriented on the left side of a fork lift truck as illustrated in FIG. 1.
Figure 4:
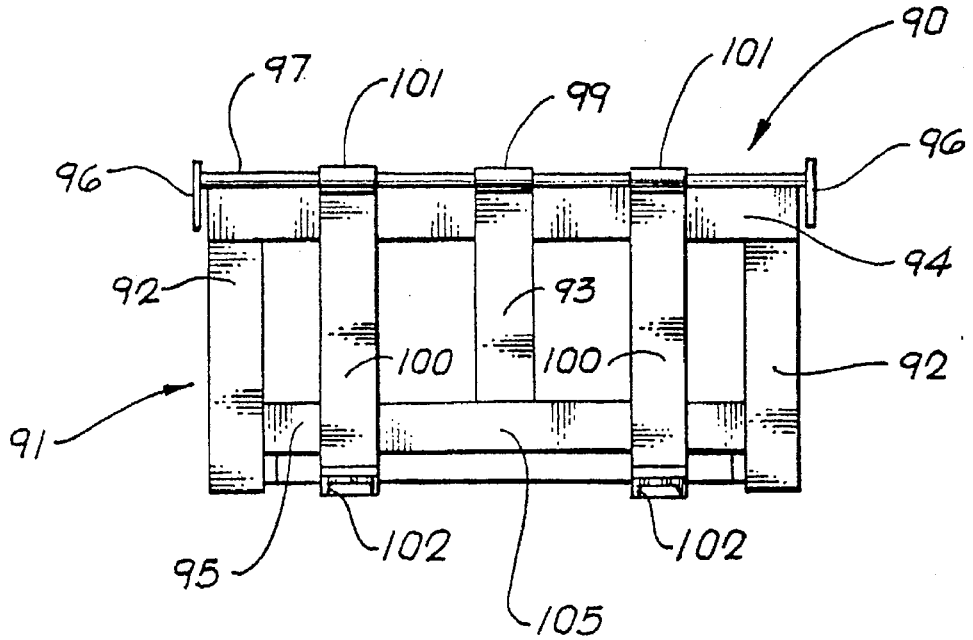
FIG. 4 is a front elevational view of the auxiliary attachment hereof with the auxiliary fork thereof oriented as shown in FIG. 1.

While it is fully contemplated that the hydraulic actuators 55 and 56 may be powered directly from the hydraulic system associated with the lift truck 15 by means of intercoupling the actuators via suitable hydraulic hose 106 with the hydraulic pump of the lift truck, it is also contemplated that an auxiliary power system as indicated 110 may be used (see FIGS. 1 and 3 of the drawings). Basically such an auxiliary power system 110 comprises a storage tank 111, pump means 112 and hoses 113, 114 respectively, coupling the output of the pump 112 with the actuators 55 and 56 as best illustrated in FIG. 6 of the drawings. The pump 112 may be powered electrically from a suitable storage battery (not shown) carried on the turn table or alternatively by the generator or battery pack associated with the lift truck 15. Alternatively, pump 112 may be powered by a gasoline engine carried by the turn table assembly hereof.

Figure 8:
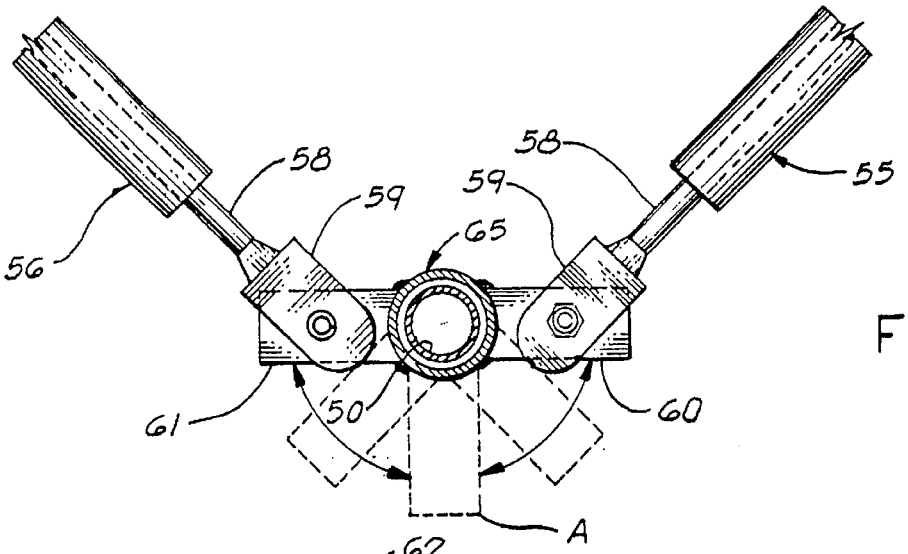
FIG. 8 is a partial, enlarged top plan view of hydraulic actuators partially shown in FIG. 7.

It will be recalled that pin 62 is selectively engaged with one of the crank arms 60 and 61 and the clevis 59 associated therewith respectively, as shown in FIG. 7. Thus, power actuation of the engaged actuator 55, for example, will serve to swing the hub 65 and turn table in accordance with the extension of the actuator piston assembly 58 for moving the crank arm 60 to a dotted line alternative position indicated at A in FIG. 8. As shown in FIG. 5, operation of the actuator 55 will serve to move the auxiliary lift fork assembly 90 from a position of symmetrical alignment with the movement axis of the lift truck to a position disposed 90° clockwise therefrom. Conversely, if it is desired to move the auxiliary fork assembly 90 to the opposite side of the lift truck's movement axis, the actuator 55 is disconnected from pin 62 and actuator 56 is then coupled to crank 61 by pin means 62. Operation of actuator 56 to extend its piston rod 58 will then move crank arm 61 to the alternate position "A" as illustrated in FIG. 8 of the drawings. Thus, the auxiliary lift arms hereof are selectively actuated to the right (clockwise) or to the left (counter clockwise) of the movement axis of the lift truck with which they are associated in accordance with the operator's need. Return movement of the forks from the lateral positions indicated in FIG. 5, to the central position symmetrically of the movement axis of the lift truck, is accomplished by reverse movement of actuators 55 or 56 in a known and conventional manner and preferably in accordance with conventional controls adjacent the operator's position within the cab of the lift truck 15.

It further will be recalled that the guide assembly 77 underengages the guide track 45 rearwardly of the trunnion post 50 and the central hub 56 of the turn table. In addition bearing means 88 of assembly 85 engages the upper side of the turn table adjacent its rear semi-circular periphery. These two assemblies 77 and 85 serve to prevent horizontal tilting of the turn table about the trunnion post when the auxiliary fork assembly is carrying a load.

From the foregoing it is believed that those familiar with the art will readily understand and appreciate the novel advancement presented by this invention and will recognize further that while the same has herein been described in association with a preferred illustrative embodiment thereof, shown in the accompanying drawings and described hereinabove, the same is susceptible to modification, variation, and substitution of equivalents without departing from the spirit and scope of the invention which is intended to be unlimited by the foregoing except as may appear in the following appended claims.

The embodiments of the invention in which an exclusive property or privilege is claimed are defined as follows:

1. A turn table attachment for use with a vertically moveable lift fork on a front loading lift truck, comprising:

a generally horizontal base frame having parallel spaced frame members receptive of tines of said lift fork;

a trunnion post extending upwardly from said base frame to define a vertical axis;

a substantially horizontal planar turn table mounted on said base frame including hub means engageable with said trunnion post for rotation about said vertical axis;

plural bearing means mounted on said base frame for engaging upper and lower surfaces of said turn table;

an auxiliary lift fork mounted over the upper surface of said turn table and having parallel spaced fork tines extending beyond a periphery of said turn table whereby to project forwardly of the latter in parallel alignment with a normal travel axis of said lift truck; and plural power actuator means mounted on said base frame beneath said turn table and operable to selectively rotate said turn table through an arc of substantially 180° whereby to align said auxiliary lift fork transversely of said travel axis, so that loads may be engaged, transported and unloaded on either side of said lift truck.

2. The turn table attachment of claim 1, and a semicircular guide track supported on said base frame beneath said turn table, and a guide assembly connected to said turn table and extending beneath said guide track for counteracting loads on said auxiliary lift fork assembly whereby to prevent tilting of said turn table about said vertical axis.

* * * * *